United States Patent [19]

Boda

[11] Patent Number: 4,846,300

[45] Date of Patent: Jul. 11, 1989

[54] PLASTIC AIR INTAKE SILENCER BOX FOR MARINE ENGINE

[75] Inventor: James C. Boda, Winneconne, Wis.

[73] Assignee: Brunswick Corporation, Skokie, Ill.

[21] Appl. No.: 173,138

[22] Filed: Mar. 24, 1988

[51] Int. Cl.[4] ..... F02M 35/00

[52] U.S. Cl. ..... 181/229; 181/243; 181/282; 440/88; 440/900

[58] Field of Search ..... 181/214, 229, 243, 282; 440/88, 900

[56] References Cited

U.S. PATENT DOCUMENTS

| | | | |
|---|---|---|---|
| 3,557,902 | 1/1971 | Brown et al. | 181/229 |
| 3,826,332 | 7/1974 | Tuckey | 181/229 |
| 4,093,039 | 6/1978 | Morre et al. | 181/229 |
| 4,109,751 | 8/1978 | Kabele | 181/229 X |
| 4,136,756 | 1/1979 | Kawamura | 181/229 |
| 4,319,657 | 3/1982 | Nomura | 181/229 X |
| 4,326,600 | 4/1982 | Okazaki et al. | 181/229 |
| 4,569,415 | 2/1986 | Breckenfeld et al. | 181/229 |
| 4,620,607 | 11/1986 | Breckenfeld et al. | 181/229 |

*Primary Examiner*—B. R. Fuller

*Attorney, Agent, or Firm*—Andrus, Sceales, Starke & Sawall

[57] ABSTRACT

A marine engine (18) is provide with a multi section injection molded thermoplastic air box (24) directing air to the fuel system's air intake throat (22) and silencing engine noise emitted back through the throat. The air box has a cover section (28) and a base section (26) mounted to each other solely by a seal (30) along a peripheral seam around the entire perimeter thereof, to prevent fuel leaks. The housing sections are preassembled to each other prior to mounting to the air intake throat. A removeable plug (70) in the cover section allows access through the cover section to bolts (56, 58) mounting the base section to the throat. Access is also enabled to a fuel adjustment screw (74) to enable adjustment, with the air box fully assembled and mounted in place on the throat, to enable adjustment under actual operating conditions. Air guide passages (32, 34) and an air plenum chamber (36) are all molded in place.

7 Claims, 3 Drawing Sheets

PLASTIC AIR INTAKE SILENCER BOX FOR MARINE ENGINE

BACKGROUND AND SUMMARY

The invention relates to air intake silencer boxes for marine engines. An air box is typically mounted to the air intake throat of the carburetor for directing air thereto and for silencing engine noise emitted back through the carburetor throat.

An air box is an air chamber with tubes of predetermined length and area connecting the inside of the box to the outside environment. Prior boxes have typically been a multipiece assembly, including a die cast metal plate with tubes cast in place and mounted to the carburetor. An air box cover and gasket are mounted to the plate and held in place by screws threaded into tapped openings in the plate. Two cycle engines have a tendency to spit fuel back out through the carburetor throat, which fuel collects in the bottom of the air box. A fitting may be included in the bottom of the box to drain such fuel. Fuel leakage from the box has been a continuing problem, particularly at the noted gasket.

The present invention provides a solution to the above noted and other problems. In preferred form, a two piece injection molded thermoplastic air box has air guide passages and an air plenum chamber all molded in place. The two housing sections are preassembled to each other and sealed along a peripheral seam. The assembly does not leak, reduces weight, reduces assembly time, and substantially reduces cost.

After the box is preassembled and sealed, it is mounted to the air intake throat of the carburetor or other fuel delivery structure such as a fuel injection manifold. A base section of the assembly has an aperture therethrough over the throat, and means are provided for mounting the base section to the throat. A cover section of the assembly has a removable plug which upon removal allows access to the base section and mounting means through the cover section to permit mounting of the base section to the throat by the mounting means, followed by replacement of the plug.

In a particularly desirable aspect of the invention in combination with a carburetor having a fuel adjustment screw adjacent the air intake throat, the assembly includes structure enabling the adjusting screw to be adjusted with the air box mounted in place on the carburetor throat, to faciliate more accurate adjustment of the carburetor by enabling adjustment under actual operating conditions, with the entire assembled air box in place.

DETAILED DESCRIPTION

Figure 1:
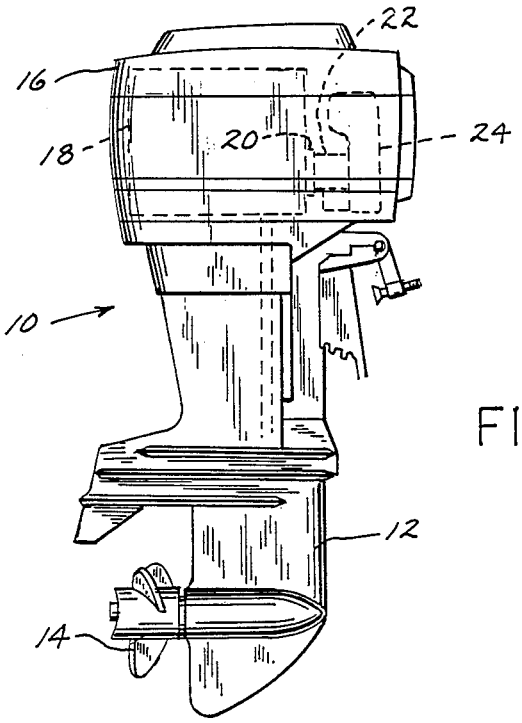
FIG. 1 shows an outboard marine propulsion unit having an air box shown in dashed line.
Figure 4:
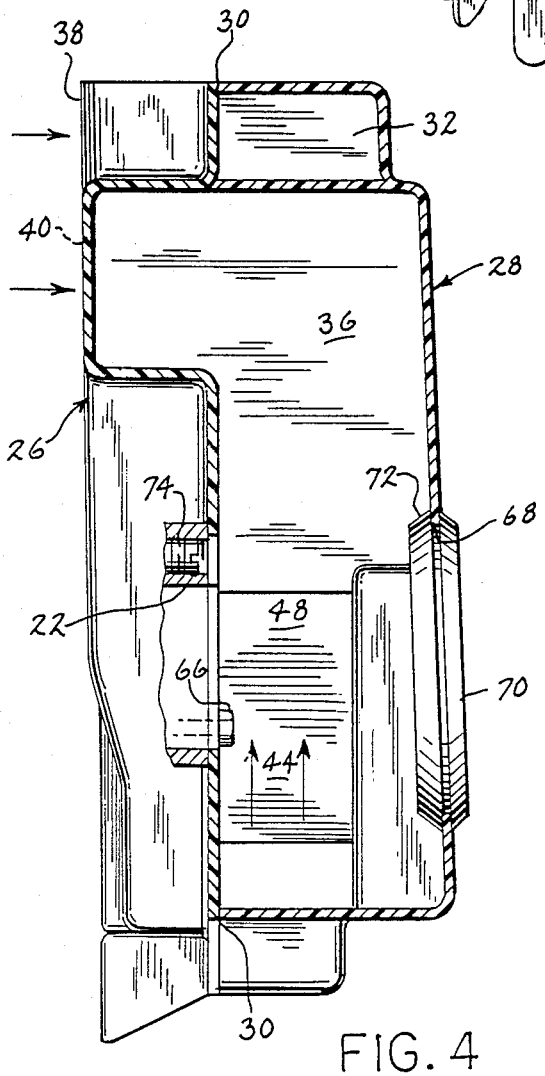
FIG. 4 is a sectional view taken along line 4—4 of FIG. 2.
Figure 5:
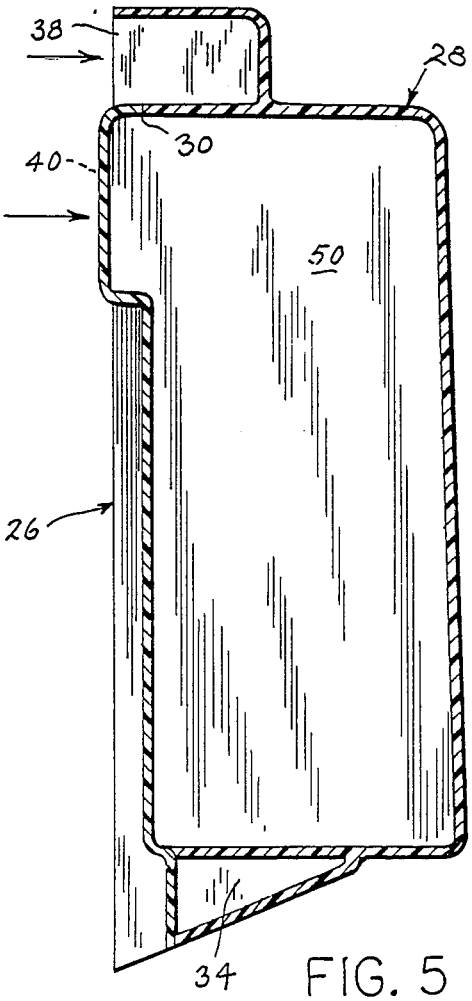
FIG. 5 is a sectional view taken along line 5—5 of the FIG. 2.
Figure 6:
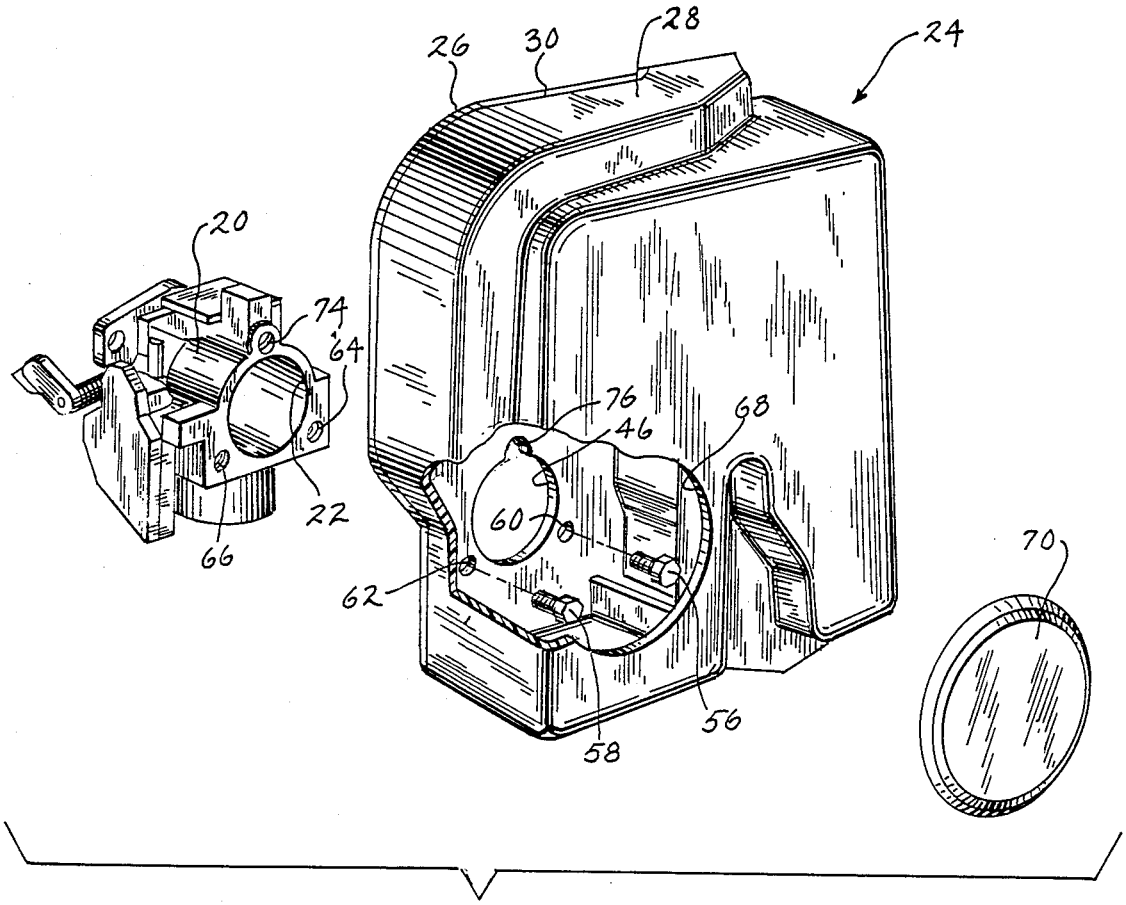
FIG. 6 is an exploded perspective view of the air box showing its mounting to a carburetor air intake throat.

FIG. 1 shows an outboard marine propulsion unit 10 including a lower gearcase strut 12, propeller 14, and upper cowl 16 enclosing internal combustion engine 18 having fuel delivery structure provided by carburetor 20 having a horizontal air intake throat 22, FIG. 6. Alternatively, the fuel delivery structure is provided by a fuel injection system with an air intake throat. Air box 24 is mounted to air intake throat 22 for directing air thereto and for silencing engine noise emitted back through the throat.

Figure 2:
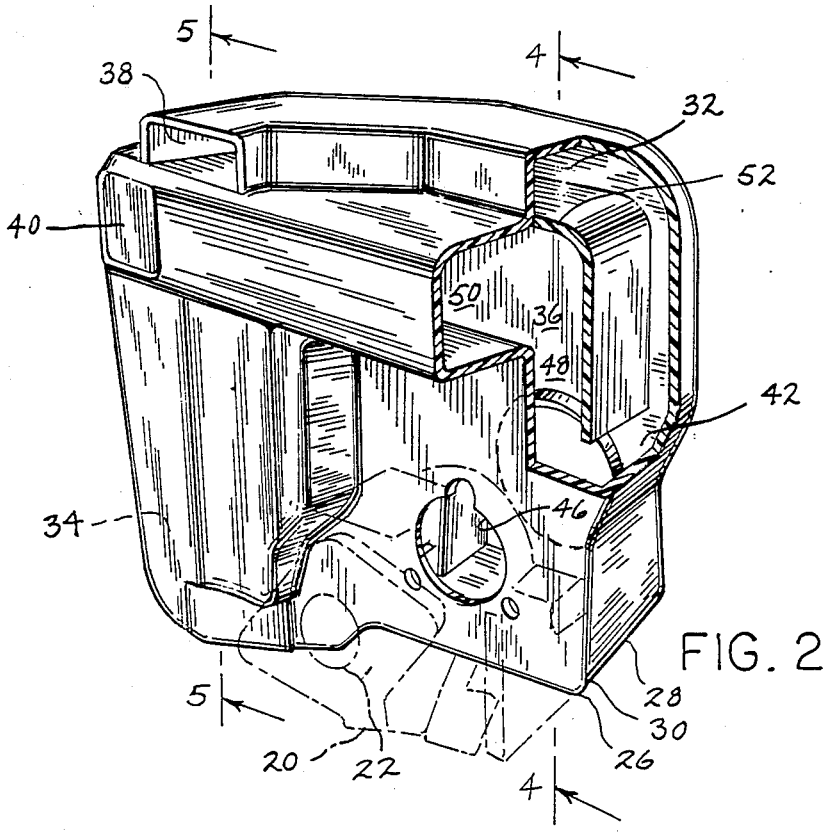
FIG. 2 is a perspective view partially cut away of an air box in accordance with the invention.
Figure 3:
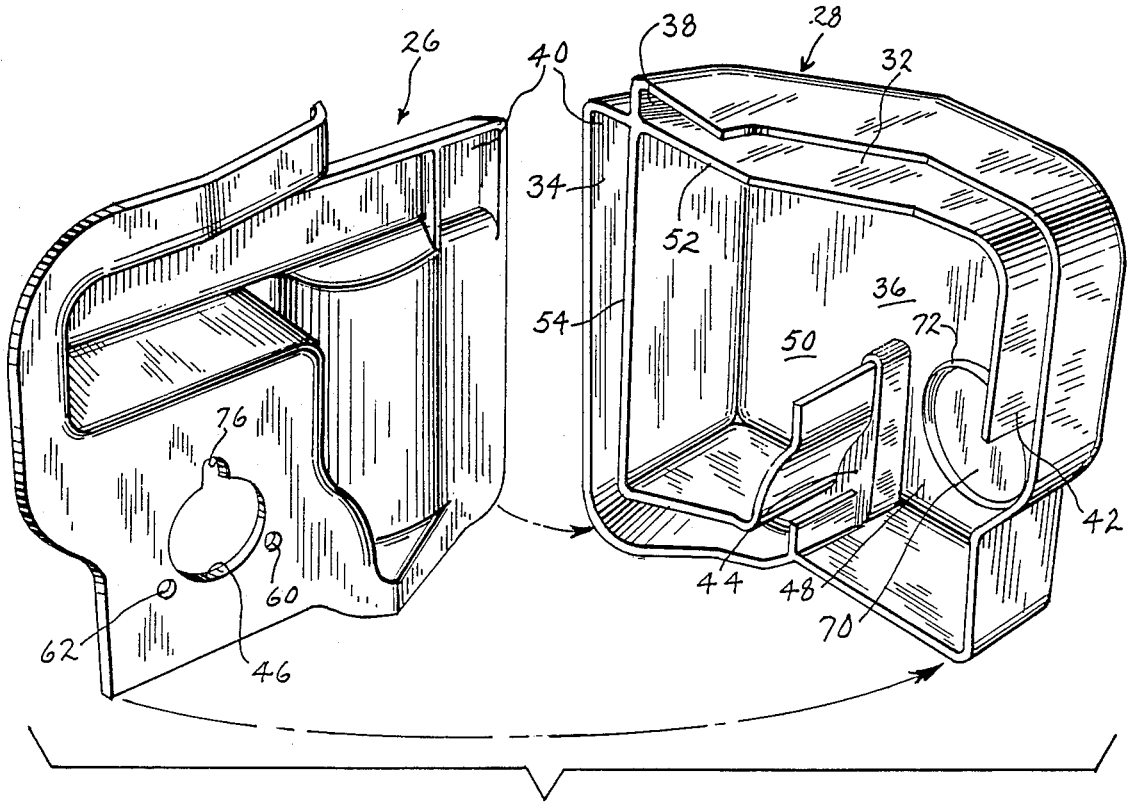
FIG. 3 is a perspective view of the air box of FIG. 2 with housing sections separated from each other.

Air box 24 is a two piece injection molded thermoplastic member having a base housing section 26, FIG. 3, and a cover housing section 28. Housing sections 26 and 28 are sealed to each other along a peripheral seam 30 lying in a vertical plane, FIGS. 2 and 6, around their entire perimeter. The housing sections are sealed to each other along seam 30 by sonic welding, or alternatively by vibration welding, hot plate welding, gluing or the like. Housing sections 26 and 28 are mounted to each other solely by the seal along peripheral seam 30, without screws, fasteners, and the like. This eliminates gaskets and prevents fuel leaks with a simple economical seal between identical material parts.

Air box 24 has a pair of air guide passages 32 and 34, FIG. 3, and an air plenum chamber 36 all molded in place. Air guide passages 32 and 34 have entry openings 38 and 40, respectively, FIG. 2, receiving air, and have exit openings 42 and 44, respectively, FIG. 3, communicating with air plenum chamber 36. Air plenum chamber 36 communicates with carburetor air intake throat 22 through aperture 46 in base section 26. Air guide passages 32 and 34 extend along opposite peripheral sides of the air box, and air plenum chamber 36 is between air guide passages 32 and 34. Air plenum chamber 36 has a portion 48 directly in line with aperture 46 in base section 26 and carburetor intake throat 22. Entry openings 38 and 40 of the air guide passages are adjacent each other, and exit openings 42 and 44 of the air guide passages face each other on opposite sides of portion 48 of air plenum chamber 36. Air plenum chamber 36 has another portion 50 between portion 48 and entry openings 38 and 40 and separated from the latter by molded wall sections 52, 54. Wall sections 52 and 54 are molded in place and define air guide passages 32 and 34 and plenum chamber 36.

Base section 26 and cover section 28 of the air box are preassembled to each other along sealed seam 30 prior to mounting to carburetor throat 22. Threaded bolts 56 and 58, FIG. 6, are provided for mounting base section 26 and hence preassembled air box 24 to the carburetor throat. Bolts 56 and 58 extend through respective aperture 60 and 62 in base section 26 and into threaded bores 64 and 66 in the carburetor for securing base section 26 to carburetor throat 22. Cover section 28 has an aperture 68 therethrough with a removeable plug 70 therein. Plug 70 extends into plenum chamber 36 at portion 48 above throat 22. Removal of plug 70 allows access to base section 26 through cover section aperture 68 to permit mounting of base section 26 to carburetor throat 22 by bolts 56 and 58. Plug 70 is a rubber circular member with an inner lip 72 engaging the inside of cover section 28 around aperture 68 and being deformable to allow ready removal and replacement of the plug.

Carburetor 20 has a fuel adjustment screw 74, FIG. 6, adjacent throat 22. Base section 26 of the air intake box includes another aperture 76, which is a part of and an extension of aperture 46, over adjusting screw 74. Removal of plug 70 in cover section 28 permits access to adjusting screw 74 through aperture 68 in cover section 28 and aperture 76 in base section 26. This is significant because it allows adjusting screw 74 to be adjusted with air box 24 preassembled and mounted in place on carburetor throat 22. This facilitates more accurate adjustment of the carburetor by enabling adjustment under actual operating conditions, with assembled air box 24 mounted in place.

It is recognized that various equivalents, alternatives and modifications are possible within the scope of the appended claims.

I claim:

1. A marine propulsion unit comprising an internal combustion engine having fuel delivery structure with an air intake throat, an air box mounted to said throat for directing air thereto and for silencing engine noise emitted back through said throat, said box comprising a molded plastic member having one or more air guide passages and an air plenum chamber all molded in place, a pair of air guide passages having entry openings receiving air, and having exit openings communicating with said air plenum chamber, wherein said air plenum chamber communicates with said air intake throat, said pair of air guide passages extend along opposite peripheral sides of said air box, said air plenum chamber is between said air guide passages, said air plenum chamber has a portion directly in line with said air intake throat, said entry openings of said air guide passages are adjacent each other, and said exit openings of said air guide passages face each other on opposite sides of said portion of said air plenum chamber directly in line with said air intake throat.

2. The invention according to claim 1 wherein said air plenum chamber has a second portion between said first mentioned portion and said entry openings of said air guide passages and separated from the latter by molded wall sections.

3. A marine propulsion unit comprising an internal combustion engine having fuel delivery structure with a horizontal air intake throat, an air box mounted to said throat for directing air thereto and for silencing engine noise emitted back through said throat, said air box comprising a two piece molded plastic member having first and second housing sections sealed to each other with a fuel impervious seal along a peripheral seam lying in a vertical plane, said first and second housing sections being mounted to each other solely by said seal along said peripheral seam, without screws, fasteners, and the like, to prevent fuel leaks.

4. The invention according to claim 3 wherein said second housing section has a plurality of inner wall sections molded in place defining one or more air guide passages and an air plenum chamber, said one or more air guide passages having entry openings receiving air, and having exit openings communicating with said plenum chamber.

5. A marine propulsion unit comprising an internal combustion engine having fuel delivery structure with an air intake throat, an air box mounted to said throat for directing air thereto and for silencing engine noise emitted back through said throat, said air box comprising a multi-piece molded plastic member including a base section and a cover section assembled and sealed to each other by a seal along a peripheral seam and forming a plenum chamber, said base section and said cover section being preassembled to each other prior to mounting to said throat, said base section having an aperture therethrough mounted over said throat, and comprising attachment means mounting said base section to said throat, and comprising a removeable plug in said cover section which upon removal allows access to said base section through said cover section to permit mounting of said base section to said throat by said attachment means, followed by replacement of said plug.

6. The invention according to claim 5 wherein said base section has a pair of apertures adjacent said first mentioned aperture and wherein said attachment means comprises a pair of threaded bolts extending through said last mentioned apertures and securing said base section to said throat, and wherein said removeable plug in said cover section extends into said plenum chamber above said throat and permits direct access to said bolts.

7. A marine propulsion unit comprising an internal combustion engine having a carburetor with an air intake throat and a fuel adjustment screw adjacent said throat, an air box mounted to said throat for directing air thereto and for silencing engine noise emitted back through said throat, said air box comprising a multi-piece molded plastic member having a base section and a cover section preassembled and sealed to each other prior to mounting to said carburetor throat, means mounting said base section to said carburetor throat, an aperture in said base section over said adjusting screw, an aperture in said cover section, a removeable plug in said aperture in said cover section permitting access to said adjusting screw through said aperture in said cover section and said aperture in said base section upon removal of said plug, such that said adjusting screw may be adjusted with said air box mounted in place on said carburetor throat, to facilitate more accurate adjustment of said carburetor by enabling adjustment under actual operating conditions with said air box mounted in place.

* * * * *